United States Patent [19]

Ricketts et al.

[11] 4,366,987

[45] Jan. 4, 1983

[54] METHOD FOR FORMING AN IN SITU OIL SHALE RETORT WITH HORIZONTAL FREE FACES

[75] Inventors: Thomas E. Ricketts, Grand Junction, Colo.; Robert J. Fernandes, Bakersfield, Calif.

[73] Assignee: Occidental Oil Shale, Inc., Grand Junction, Colo.

[21] Appl. No.: 208,862

[22] Filed: Nov. 21, 1980

[51] Int. Cl.[3] ..... E21C 41/10

[52] U.S. Cl. ..... 299/2; 102/312; 299/13

[58] Field of Search ..... 299/2, 13; 166/299; 102/311, 312

[56] References Cited

U.S. PATENT DOCUMENTS 3,466,094 9/1969 Haworth et al. ..... 299/13

4,025,115 5/1977 French et al. ..... 299/13 X

OTHER PUBLICATIONS

Blasters' Handbook, DuPont, 1969, 15th Edition, pp. 408–420.

Swedish Blasting Technique SPI, Sweden, 1973, pp. 163–180.

*Primary Examiner*—Ernest R. Purser

*Attorney, Agent, or Firm*—Christie, Parker & Hale

[57] ABSTRACT

A method for forming a fragmented permeable mass of formation particles in an in situ oil shale retort is provided. A horizontally extending void is excavated in unfragmented formation containing oil shale and a zone of unfragmented formation is left adjacent the void. An array of explosive charges is formed in the zone of unfragmented formation. The array of explosive charges comprises rows of central explosive charges surrounded by a band of outer explosive charges which are adjacent side boundaries of the retort being formed. The powder factor of each outer explosive charge is made about equal to the powder factor of each central explosive charge. The explosive charges are detonated for explosively expanding the zone of unfragmented formation toward the void for forming the fragmented permeable mass of formation particles having a reasonably uniformly distributed void fraction in the in situ oil shale retort.

41 Claims, 3 Drawing Figures

METHOD FOR FORMING AN IN SITU OIL SHALE RETORT WITH HORIZONTAL FREE FACES

FIELD OF THE INVENTION

This invention relates to the formation of an in situ oil shale retort containing a fragmented permeable mass of formation particles in a retort site within a subterranean formation. More particularly, this invention relates to expanding unfragmented formation toward a void for forming a fragmented permeable mass of formation particles in an in situ oil shale retort having a reasonably uniformly distributed void fraction.

BACKGROUND OF THE INVENTION

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents such as U.S. Pat. Nos. 3,661,423; 4,043,597; 4,043,598; and 4,192,554; and in U.S. patent application Ser. No. 070,319 filed Aug. 27, 1979, by Chang Yul Cha, entitled TWO-LEVEL, HORIZONTAL FREE FACE MINING SYSTEM FOR IN SITU OIL SHALE RETORTS and now abandoned. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process.

U.S. Pat. Nos. 4,043,597; 4,043,598; and 4,192,554 disclose methods for explosively expanding formation containing oil shale toward horizontal free faces to form a fragmented mass in an in situ oil shale retort. According to such a method, a plurality of vertically spaced apart voids of similar horizontal cross-section are initially excavated one above another within the retort site. A plurality of vertically spaced apart zones of unfragmented formation are temporarily left between the voids. A plurality of horizontally spaced apart vertical columnar explosive charges, i.e., an array of explosive charges, is placed in each of the unfragmented zones and detonated to explosively expand each unfragmented zone upwardly and/or downwardly towards the void or voids above and/or below it to form a fragmented mass having an average void volume about equal to the void volume of the initial voids. Retorting of the fragmented mass is then carried out to recover shale oil from the oil shale.

U.S. patent application Ser. No. 070,319 discloses a method for explosively expanding formation containing oil shale towards a horizontal free face to form a fragmented mass in an in situ oil shale retort. According to such a method, a void having a horizontal cross-section similar to the horizontal cross-section of the retort being formed is initially excavated. A plurality of vertically spaced apart zones of unfragmented formation are left above the void. Explosive is placed in each of the unfragmented zones and detonated for explosively expanding such zones towards the void to form a fragmented mass in the retort having an average void volume about equal to the void volume of the initial void. The overlying zones can be expanded towards the void in a single round or a plurality of rounds. Retorting of the fragmented mass is then carried out to recover shale oil from the oil shale.

It is desirable to have a generally uniformly distributed void fraction in the fragmented mass so that there is generally uniform permeability. Thus, oxygen-supplying gas and combustion gas can flow reasonably uniformly through the fragmented mass during retorting operations. A fragmented mass having generally uniform permeability avoids bypassing portions of the fragmented mass by retorting gas as can occur if there is gas channeling through the mass due to non-uniform permeability.

When using vertical columnar explosive charges for explosively expanding formation, some of the blastholes containing such charges can be located close to the vertical walls of a void towards which expansion is directed. The charges in these blastholes are not free to crater toward the horizontal free face (i.e., upward or downward, as the case may be), but are confined on one side by the wall. Formation expanded by these charges is directed in some measure inwardly away from the walls and not entirely vertically, as desired. This can cause the fragmented mass of formation particles formed to have a higher void fraction along the walls of the retort and a lower void fraction near the center. Having a fragmented permeable mass with a higher void fraction along the walls and a lower void fraction in about the center can result in gas channeling along the walls and consequent reduction in the efficiency of the retorting process.

In the past, columnar explosive charges in the blastholes adjacent the plane of the vertical walls of a void have been provided which are about the same size or energy and have about the same spacing distance as explosive charges remote from the side walls.

The "spacing distance" as used herein is the distance between adjacent explosive charges or blastholes.

Explosive in a blasthole adjacent the plane of a vertical wall of a void can expand only that portion of the zone of unfragmented formation which can break to an adjacent free face. Therefore, an explosive charge adjacent a vertical wall is free to expand only about one-half the volume of formation that it could expand if it were located remote from the wall. As a consequence, more explosive has been provided in charges along such side walls than is actually required to expand the unfragmented formation in this region.

When charges adjacent a side wall are more energetic than necessary, formation is expanded to a greater extent than necessary toward the center of the retort. This enhances the uneven distribution of void fraction across the horizontal extent of the fragmented permeable mass of formation particles formed in the retort. Also, using more explosive than necessary results in an increased expense, both because of the additional explosive used and also because of the added expense of drilling larger blastholes than required along the walls.

Additionally, when the amount of explosive used to expand a given volume of formation in a region adjacent a void wall is greater than the amount of explosive used to expand a given volume of formation more remote from the void wall, fragmentation of formation is not uniform. That is, particles formed by detonation of the explosive charge adjacent the side wall are smaller than particles formed by detonation of charges more remote from the side wall.

It is, therefore, desirable to provide an economical method for expanding formation toward a horizontal free face which results in a fragmented mass of formation particles having a reasonably uniform particle size distribution and void fraction distribution.

SUMMARY OF THE INVENTION

This invention relates to a method for forming a fragmented permeable mass of formation particles in an in situ oil shale retort in a retort site in a subterranean formation containing oil shale. The in situ oil shale retort site has top, bottom, and side boundaries of unfragmented formation. At least one void is formed in the subterranean formation within the boundaries of the retort site and at least one zone of unfragmented formation is left adjacent such a void. An array of spaced apart explosive charges is placed in such a zone of unfragmented formation. The array of explosive charges comprises a plurality of central explosive charges spaced apart from the side boundaries of the retort site and a plurality of outer explosive charges adjacent such a side boundary of the retort site. Each such outer explosive charge has a powder factor in the range of from about one-half to less than twice the powder factor of each such central explosive charge. The explosive charges are then detonated for explosively expanding the zone of unfragmented formation toward the void for forming a fragmented permeable mass of formation particles in the in situ oil shale retort.

DRAWINGS

These and other features, aspects, and advantages of the present invention will be more fully understood when considered with respect to the following detailed description, appended claims, and accompanying drawings wherein:

DETAILED DESCRIPTION

Figure 1:
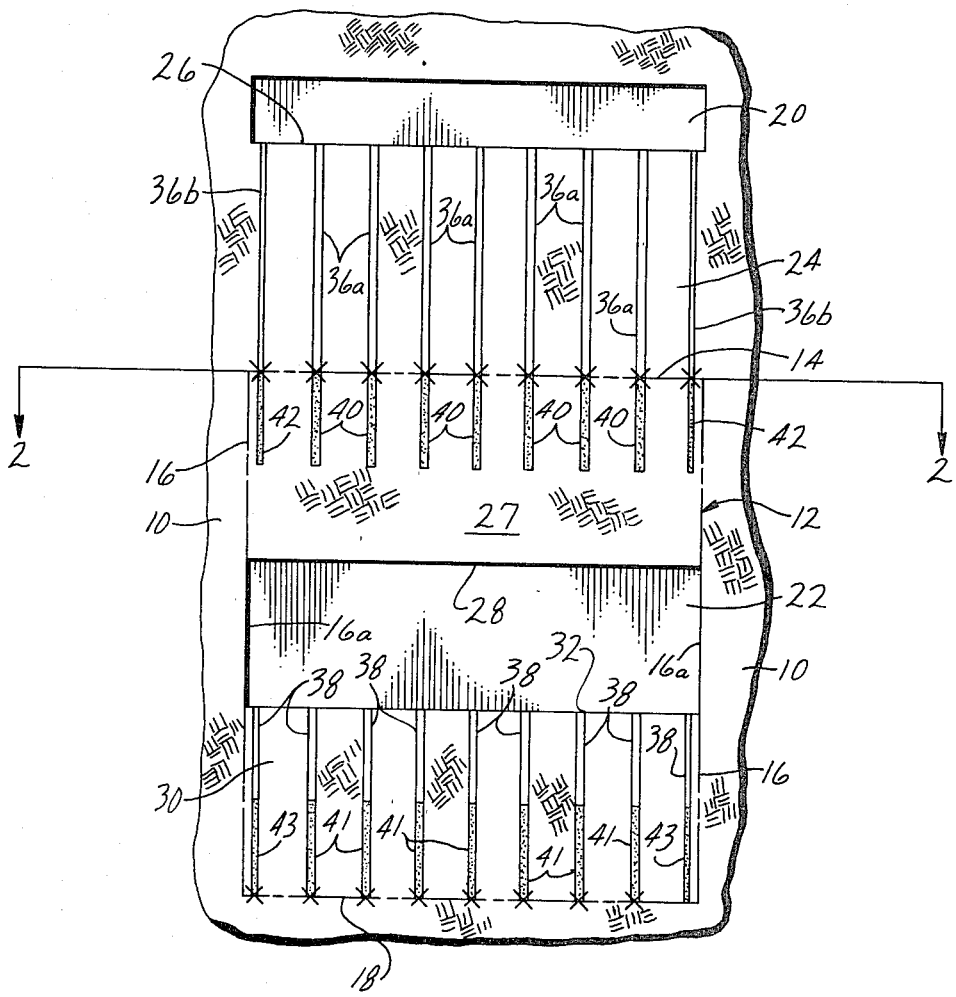
FIG. 1 is a fragmentary, semi-schematic, vertical cross-sectional view showing a portion of a subterranean formation containing oil shale at one stage during preparation for explosive expansion for forming an in situ oil shale retort.
Figure 2:
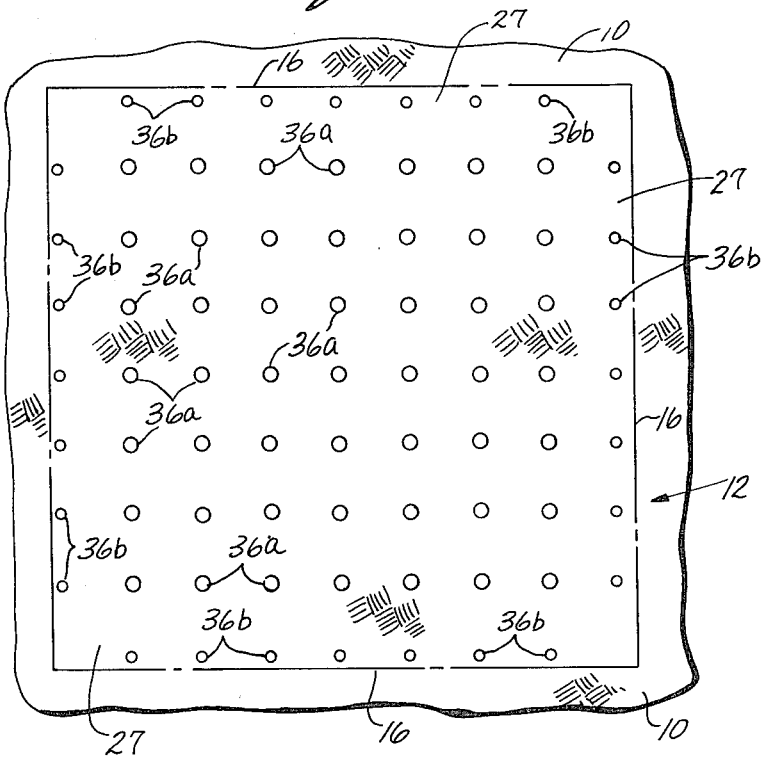
FIG. 2 is a semi-schematic, horizontal cross-sectional view taken on line 2—2 of FIG. 1 showing an array of blastholes.

Referring to FIGS. 1 and 2, there are shown semi-schematic vertical and horizontal cross-sectional views of a portion of a subterranean formation 10 containing oil shale. The subterranean formation is at one stage of preparation for explosive expansion for forming an in situ oil shale retort 12. The in situ retort is rectangular in horizontal cross-section, having a top boundary 14, four vertically extending side boundaries 16, and a bottom boundary 18 of unfragmented formation. If desired, retorts having other horizontal cross-sections or other shapes can also be formed by practice of principles of this invention.

When explosively expanding formation using a horizontal free face system of an exemplary embodiment, an open base of operation 20 can be excavated in the formation for providing effective access across substantially the entire horizontal cross-sectional of the retort being formed. The base of operation can be used during formation of the retort and additionally can facilitate ignition of a fragmented permeable mass of formation particles formed in the retort. The base of operation can also provide a location for control of introduction of oxygen-supplying gas into the retort and for evaluating performance of the retort during its operation. If desired, such an underground base of operation can be deleted and the aforementioned operations performed from the ground surface. Alternatively, access can be afforded from a drift or drifts extending above or adjacent the retort.

A generatlly horizontally extending void 22 bounded by generally vertical side walls 16*a* is excavated at a level spaced vertically below the base of operation. It is desired that the excavated void volume comprises at least about 15% of the total volume of the retort being formed.

A layer of unfragmented formation is left which extends vertically between the base of operation 20 and the void 22. The layer of unfragmented formation above the void 22 can comprise a sill pillar 24 of unfragmented formation extending from about the floor 26 of the base of operation to the top boundary 14 of the retort being formed. The sill pillar acts as a barrier between the in situ oil shale retort and the base of operation during retorting operations, thereby protecting the base of operation from heat and from gases evolved during such retorting operations. In an alternative embodiment, the unfragmented formation above the top boundary extends all the way to the ground surface.

The layer of unfragmented formation also comprises an upper zone 27 of unfragmented formation. The upper zone of unfragmented formation extends horizontally across the retort site between the top boundary 14 of the retort being formed and a substantially horizontal free face 28 above the void 22. A lower zone 30 of unfragmented formation is left in the subterranean formation below the void 22, wherein the lower zone extends horizontally across the retort site between the bottom boundary 18 of the retort being formed and a substantially horizontal free face 32 at the floor of the void.

For clarity of illustration, in the exemplary embodiment, unfragmented formation is expanded toward only one void, i.e., the void 22. If desired, however, in practice of principles of this invention, more than one void can be excavated in the subterranean formation and formation can be expanded toward the excavated voids.

Additional details of expanding formation toward several voids is described in U.S. Pat. No. 4,192,554, incorporated hereinabove by reference. If desired, plural layers can be explosively expanded downwardly towards a single underlying void.

In practice of principles of this invention, an array of horizontally spaced apart explosive charges is formed, i.e., placed, in at least one of the zones of unfragmented formation. The array of explosive charges comprises a plurality of central explosive charges 40 spaced apart from the side boundaries 16 and a plurality of outer explosive charges 42 in a band surrounding the central charges. In an exemplary embodiment, the outer explosive charges are in blastholes adjacent the vertical side walls 16*a* of the void 22, i.e., the outer charges are located adjacent the side boundaries 16 of the retort being formed.

As described above, in the past, explosive charges in blastholes adjacent the plane of the vertical side walls of a void have been provided which are about the same size and have about the same spacing distance as explosive charges remote from the side walls. This results in each charge adjacent the side boundaries, i.e., adjacent the side walls of the void, having about twice the powder factor as the charges remote from the side walls.

The term "powder factor" as used herein is the ratio of the amount or energy of explosive used per unit volume of formation explosively expanded, e.g., pounds of ANFO equivalent per cubic yard of formation. The powder factor of the outer charges is twice as large as the powder factor of central charges since the volume of formation expanded by the outer charges is about half that expanded by the central charges due to the wall constraints.

In practice of this invention, the powder factor of each outer charge is in the range of from about one-half to less than about twice the powder factor of each central charge. Preferably, the powder factor of each outer explosive charge is in the range of from about one-half to about one and one-half times the powder factor of each central explosive charge. More preferably, the powder factor of each outer explosive charge is about equal to the powder factor of each central explosive charge. Powder factors within this range can be selected as desired. The powder factor is reduced by reducing the quantity of explosive in the outer explosive charges.

For instance, when the powder factor of an outer charge is less than about $\frac{1}{2}$ times the powder factor of a central charge, the amount of formation expanded toward the center of the retort is minimized. However, there may not be sufficient explosive energy in such an outer explosive charge to expand the formation adjacent the side wall of the void to its desired extent.

On the other hand, when the powder factor of an outer explosive charge exceeds about one and one-half times the powder factor of a central charge, the degree of fragmentation of formation adjacent a side wall of a void is enhanced. However, the amount of formation expanded inwardly toward the center of the retort by such an explosive charge can be more than desired.

In the exemplary embodiment described below, the powder factor of each outer explosive charge is made about equal to the powder factor of each central explosive charge. It is believed that having the powder factor of each outer explosive charge equal to the powder factor of each central explosive charge results in the most desirable combination of reducing the amount of formation expanded inwardly, while leaving the outer charge energetic enough to completely expand the formation at the side boundaries of the retort. Additionally, having outer and central explosive charges with equal powder factors results in enhanced uniformity of fragmentation across the retort since the powder factor is constant across the retort.

In this exemplary embodiment, a plurality of substantially vertical horizontally spaced apart blastholes 36 are drilled through the sill pillar 24 and into the upper zone 27 of unfragmented formation from the base of operation 20. The blastholes 36 form an array of blastholes in the upper zone of unfragmented formation. In other embodiments, where no base of operation is provided, the blastholes can be drilled from the ground surface or from one or more drifts above or adjacent the retort site. Alternatively, if desired, the blastholes can be drilled upwardly into the upper zone 27 of unfragmented formation from the void 22.

In addition to the blastholes 36 formed in the upper zone, a plurality of substantially vertical, horizontally spaced apart blastholes 38 are drilled into the lower zone 30 of unfragmented formation from the void 22, thereby forming an array of spaced apart blastholes in the lower zones.

The blastholes are shown out of proportion in the figures for clarity of illustration, i.e., the blastholes are actually much smaller in diameter relative to the formation than shown.

The blastholes can be formed in a rectangular array, including a square array, or can be formed in other configurations, if desired. The blastholes of the exemplary embodiment are generally perpendicular to the free faces of the upper and lower zones of unfragmented formation and are formed as a square array of blastholes, i.e., the spacing distance between blastholes is equal in orthogonal directions.

The array of blastholes 38 is similar in configuration to the array of blastholes 36. Therefore, for purposes of exposition, the description of the configuration of blastholes will be limited to the blastholes 36 in the upper zone of unfragmented formation.

An understanding of the configuration of the arrays of blastholes can be obtained by referring to FIG. 2, which shows the array of blastholes 36 formed in the upper zone 27 of unfragmented formation. The outline of the horizontal free face 28 is indicated by the side boundaries 16 of the retort which surround the array of blastholes 36. Central blastholes designated 36*a* are remote from the side boundaries 16, and outer blastholes designated 36*b* are in a band surrounding the center or central blastholes. The blastholes 36*b* are adjacent the vertical side walls 16*b* of the void 22, i.e., adjacent the plane of the side walls, and are smaller in diameter than the blastholes 36*a*. In the exemplary embodiment, each blasthole 36*a* has about twice the horizontal cross-sectional area as does each blasthole 36*b*. The blastholes 36*b* are preferably spaced close to the walls of the base of operation 20 or void 22, more preferably the spacing from the walls is only that amount required due to the design of the drilling equipment used for drilling the blastholes.

Each of the central blastholes 36*a* is loaded with explosive for forming substantially vertical columnar central explosive charges 40, i.e., the explosive charges are placed into the blastholes. Additionally, each of the outer blastholes 36*b* is loaded with explosive for forming substantially vertical columnar outer explosive charges 42. The explosive completely fills the horizontal cross-section of the blastholes.

The lower zone of unfragmented formation is prepared for explosive expansion upwardly toward the void 22 by loading the blastholes 38 with explosive, forming explosive charges 41 and 43 in such blastholes. The charges formed in the blastholes 38 are similar to the explosive charges formed in the blastholes 36. For simplicity, therefore, the description of explosive charges is limited to the explosive charges formed in the upper zone of unfragmented formation.

Detonators designated by an "x" are placed into each blasthole for initiating detonation of the explosive charges and the portion of each blasthole above the explosive charge is stemmed with inert material such as sand or gravel or the like.

Preferably, the spacing distance between each of the central explosive charges 40 in each of the blastholes 36*a* is about equal to the spacing distance between each of the outer explosive charges 42 in each of the blastholes 36*b*. Additionally, it is also preferred that the distance between an outer explosive charge 42 and an adjacent central explosive charge is about equal to the spacing distance between the central charges. If desired, however, the outer explosive charges can be spaced closer together than the central charges to enhance charge interaction.

The outer charges 42 are also smaller than the central charges 40. As described above, each of the outer blastholes 36*b* has about half the horizontal cross-sectional area as each of the central blastholes 36*a*. Explosive placed into the blastholes forming the outer and central charges fills the entire cross-sectional area of each of the blastholes and each outer explosive charge has about the same column length as each central explosive charge.

Although the column length of the outer and central explosive charges can be as desired, it is preferable that each outer and central explosive charge extend from about the top boundary 14 about one-half the distance to the horizontally extending free face 28. That is, each charge extends through about one-half the height or thickness of the zone of unfragmented formation 27 which is being explosively expanded toward the void 22. It has been determined that having explosive charges with a column length about one-half the thickness of the formation being expanded toward a free face generally results in the most efficient use of the explosive. The actual depth of burial of each outer explosive charge is, therefore, equal to the actual depth of burial of each central explosive charge. As used herein, the "actual depth of burial" of an explosive charge is the distance from the free face towards which unfragmented formation is being expanded to the center of mass of the charge.

In the exemplary embodiment, the amount of explosive comprising each outer explosive charge 42 is about equal to about one-half the amount of explosive comprising each central charge 40. Since each outer explosive charge expands about one-half the volume of unfragmented formation as is expanded by each central charge due to the inhibiting effect of the void walls 16*a*, and each outer charge comprises about one-half the amount of explosive as does each central charge, the powder factor of each outer explosive charge is about equal to the powder factor of each central explosive charge.

Referring again to FIG. 2, it can be seen that the array of central explosive charges formed in the blastholes 36*a* comprises rows of central charges which are remote from the side boundaries 16 of the retort. Additionally, outer explosive charges formed in the blastholes 36*b* comprise a row of outer charges extending along each side boundary. Since the powder factor of each outer explosive charge in the exemplary embodiment is equal to the powder factor of each central explosive charge, the powder factor of each row of outer explosive charges is also about equal to the powder factor of each row of central explosive charges.

When the powder factor of an outer explosive charge 42 is made about equal to the powder factor of a central charge 40, fragmentation and rotation of particles expanded by the outer charges is about equal to the fragmentation and rotation of formation expanded by the central charges. The formation particles formed by the outer charges, therefore, have about the same size and configuration as the formation particles expanded by the central charges. This enhances the uniformity of the void fraction distribution within the fragmented permeable mass across the horizontal extent of the retort.

Additionally, when the outer explosive charges are made smaller than the central charges, instead of the same size, there is less tendency for formation adjacent the side boundaries to be expanded toward the center of the retort. This enhances uniformity of void fraction distribution across the horizontal extent of the retort.

Another advantage of having outer explosive charges smaller than the central charges, instead of the same size, is that seismic vibration from detonation of the outer charges is reduced. Reduced seismic vibration results in less damage to surrounding mine structures and adjacent retorts. Additionally, using smaller outer charges improves mine stability by inhibiting damage to retort boundary walls and pillars between retorts by reducing overbreak.

As described above, the lower zone of unfragmented formation is also loaded with explosive charges which have a configuration similar to the explosive charges in the upper zone.

After the upper and lower zones of unfragmented formation are loaded with the explosive charges, the charges are detonated, either simultaneously or in a single round with time delays between detonations for explosively expanding the zones of unfragmented formation toward the void 22. Alternatively, if desired, the charges can be detonated in a plurality of separate rounds.

Practice of principles of this invention results in a fragmented permeable mass of formation particles in the in situ oil shale retort having a reasonably uniform particle size and void fraction distribution.

If, in an exemplary embodiment, it is desired that the powder factor of each outer charge is to be different from the powder factor of each central charge, yet be in the desired range of from about one-half to about one and one-half times the powder factor of each central charge, the diameter of the outer blastholes (and, hence, the diameter of the outer charges) can be altered as necessary.

For example, if the powder factor of each outer charge is about one-half the powder factor of each central charge, and the spacing between outer charges is equal to the spacing between central charges, each outer blasthole will have about one-fourth the cross-sectional area as each central blasthole. On the other hand, if the powder factor of each outer charge is about one and one-half times powder factor of each central charge, and the spacing between outer charges is equal to the spacing between central charges, each outer blasthole will have about three-fourths the cross-sectional area as each central blasthole. Some variation within the range is probable in any practical embodiment since commercially available drill bits for the blastholes can differ somewhat from the desired ratio of sizes.

In another exemplary embodiment of practice of this invention, the spacing distance between the outer explosive charges can be made less than the spacing distance between the central explosive charges. It is desirable, however, that the spacing distance between outer explosive charges be no less than about one-half the spacing distance between the central explosive charges. This is due to the high cost involved in drilling and loading additional outer blastholes and for other operational reasons.

When the spacing distance between the outer charges is less than the spacing distance between the central charges, the diameter of each outer charge is calculated to provide that each outer charge has the desired powder factor in relation to the powder factor of each central charge.

In one embodiment, for example, where the spacing distance between the outer charges is less than the spacing distance between the central charges, the diameter of each outer charge can be calculated so that each outer charge has about the same powder factor as each central charge.

Having more charges along the side boundary with less spacing results in an enhanced distribution of explosive along the side boundary which can enhance fragmentation and explosive expansion of formation in this region.

In the exemplary embodiments described above, it is preferred that the edge or outer explosive charges are formed as near the side boundaries of the retort being formed as drilling equipment design allows.

If desired, the outer explosive charges can be moved laterally from the side boundaries, i.e., from the vertical walls **16*a*** of the void. Moving the outer explosive charges laterally from the vertical walls reduces the inhibiting effect of the walls on expansion of formation adjacent the side boundaries of the retort. This results in less tendency of the outer charges to expand formation toward the center of the retort. It may be desirable, however, when the outer charges are moved laterally from the void walls, to increase the size, i.e., the amount of explosive comprising each such outer charge, because the amount of formation being expanded by each outer charge is increased.

When the edge or outer charges are spaced laterally from the walls of the void, it is desirable that the distance from the wall to such charges is not more than about one-half the spacing distance between the outer explosive charges. If the charges are moved more than about one-half the spacing distance from the void walls, the side boundaries of the retort can be irregular after the charges are detonated. This can cause uneven gas flow through the retort.

As described above in the exemplary embodiment, if desired, a zone of unfragmented formation below a void can be prepared for explosive expansion toward the void in a similar manner as the zone above the void is prepared. The zone below the void can be prepared using principles as described in any of the exemplary embodiments for preparation of an upper zone. Similar arrangements of explosive charges can also be used in each of a plurality of zones of unfragmented formation explosively expanded downwardly toward an underlying void and/or in each of a plurality of zones of unfragmented formation expanded upwardly toward an overlying void, either in a single round or in a plurality of rounds.

Although the exemplary embodiments of practice of principles of this invention are described in terms of explosive charges in vertical blastholes, the technique can also be useful when the blastholes are not vertical and the expansion is toward free faces that are not horizontal. Additionally, this invention is useful for expanding formation other than oil shale formation.

The above described technique for expanding formation toward a horizontal free face, which results in a fragmented mass of formation particles having a reasonably uniform void fraction distribution, should be distinguished from prior blasting techniques known as smooth blasting and pre-splitting or pre-shearing, which are used for obtaining smooth walls and/or decoupling explosions from adjacent formation for minimizing seismic loading. Little, if any, formation is fragmented by these techniques.

Details of pre-shearing and smooth blasting can be found in *The Blasters' Handbook,* E. I. duPont de Nemours & Co. (Inc.), 15th edition (1942), pp 399–420, and in *Swedish Blasting Technique,* SPI, Gothenburg, Sweden (1973), pp 163–180.

In pre-splitting, an array of blastholes is formed, which comprises a row of small diameter blastholes along a boundary of the formation being excavated. The spacing distance between the small diameter blastholes is less than the spacing distance between larger diameter blastholes in the array.

The blastholes used for pre-splitting are then very lightly loaded with explosive, compared to the other blastholes in the array. The light loads of explosive, for instance, can comprise a plurality of spaced apart full, or partially full, cartridges of dynamite on a detonating cord which extends down the center of the blasthole. In either case, the loads do not completely fill the cross-section of the blasthole and an air gap is left between the explosive charge and the blasthole walls. If desired, the air gap can be filled by placing stemming completely around and between the charges.

The recommended loading density for blastholes used for pre-splitting is given as from about 0.08 to about 0.75 pounds of explosive per foot of blasthole in blastholes of various diameters. This is significantly less than the loading density used for a standard explosive charge in a blasthole. For example, a "standard charge" can be formed by loading a blasthole with explosive, wherein the explosive completely fills the horizontal cross-sectional area of the blasthole.

The pre-splitting charges are all detonated before the remaining explosive charges in the array and cause cracking along the boundary of unfragmented formation which is being expanded.

In smooth blasting, a configuration of blastholes is used which is similar to the configuration of blastholes used for pre-splitting. The explosive charges in the blastholes along the perimeter of the unfragmented formation used for smooth blasting are detonated last, after the explosive charges in the other blastholes of the array have been detonated.

In smooth blasting, as was the case of pre-splitting, the blastholes along the perimeter are very lightly loaded with explosive. The recommended explosive charge density in blastholes of various diameters used for smooth blasting, for example, is from about 0.12 to about 0.25 pounds of explosive per foot of blasthole. This is significantly less than the loading density used for a standard explosive charge in a blasthole.

Figure 3:
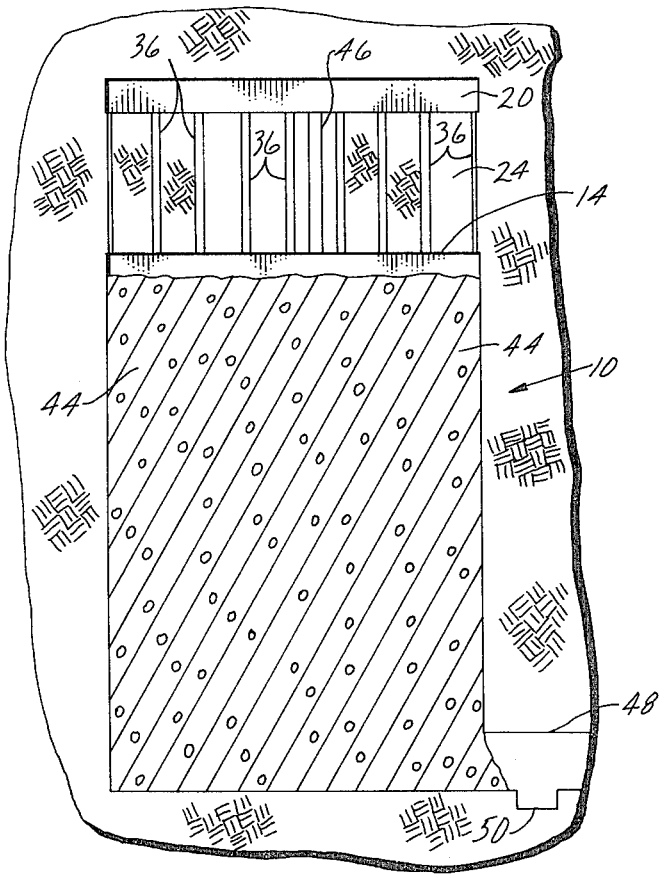
FIG. 3 is a fragmentary, semi-schematic, vertical cross-sectional view of an in situ oil shale retort formed in accordance with this invention.

In practice of this invention, after a zone(s) of unfragmented formation is expanded, forming a fragmented permeable mass 44 of oil shale particles in an in situ oil shale retort, as illustrated in FIG. 3, the final preparation steps for producing liquid and gaseous products from the retort are carried out. These steps include drilling at least one gas feed inlet passage 46 downwardly to the top boundary 14 of unfragmented formation so that oxygen-supplying gas can be introduced into the fragmented permeable mass during retorting operations. Alternatively, at least a portion of the blastholes 36 can be used for introduction of the oxygen-supplying gas. A substantially horizontal product withdrawal drift 48 extends away from the lower portion of the fragmented mass at a lower production level in the retort. The product withdrawal drift is used for removal of liquid and gaseous products of retorting.

If desired, liquid and gaseous products can be withdrawn through one or more raises, which extend upwardly from a lateral drift under the retort into a bottom portion of the fragmented mass.

During retorting operations, a combustion zone is established in the fragmented mass of formation particles and the combustion zone is advanced downwardly through such a fragmented mass by introduction of oxygen-supplying gas into the retort. Combustion gas produced in the combustion zone passes through the fragmented mass to establish a retorting zone on the advancing side of the combustion zone when kerogen in the oil shale is retorted to produce liquid and gaseous products of retorting. The liquid products and an off gas containing gaseous products pass to the bottom of the fragmented mass and are withdrawn from the product withdrawal drift 48. A pump (not shown) is used to withdraw liquid products from the sump 50 to above ground. Off gas is withdrawn by a blower (not shown) and passed to above ground.

The above description of a method for recovering shale oil from a subterranean formation containing oil shale, including the description of preparing zones of unfragmented formation for explosive expansion, is for illustrative purposes.

If desired, as described above, practice of principles of this invention can also be used for explosively expanding formation, other than oil shale formation, toward a void in a subterranean formation.

Because of variations which will be apparent to those skilled in the art, the present invention is not intended to be limited to the particular embodiments described above. The scope of the invention is defined in the following claims.

What is claimed is:

1. A method for forming a fragmented permeable mass of formation particles in an in situ oil shale retort in a retort site in a subterranean formation containing oil shale, the in situ oil shale retort site having top, bottom, and side boundaries of unfragmented formation, comprising the steps of:

excavating at least one void in the subterranean formation within the boundaries of the retort site, leaving at least one zone of unfragmented formation adjacent such a void;

placing an array of spaced apart explosive charges in such a zone of unfragmented formation, the array of explosive charges comprising a plurality of central explosive charges spaced apart from the side boundaries of the retort site and a plurality of outer explosive charges adjacent such a side boundary of the retort site, each such outer explosive charge having a powder factor in the range of from about one-half to less than twice the powder factor of each such central explosive charge; and detonating the explosive charges for explosively expanding the zone of unfragmented formation toward the void for forming a fragmented permeable mass of formation particles in the situ oil shale retort.

2. The method according to claim 1 wherein the actual depth of burial of such an outer explosive charge is about equal to the actual depth of burial of such a central explosive charge.

3. The method according to claim 1 wherein each such outer explosive charge has a powder factor about equal to the powder factor of each such central explosive charge.

4. The method according to claim 1 wherein such outer and central explosive charges are columnar explosive charges and each such outer explosive charge has a column length about equal to the column length of each such central explosive charge.

5. The method according to claim 4 wherein the column length of each such outer and central explosive charge is about equal to one-half the thickness of the zone of unfragmented formation being expanded.

6. The method according to claim 1 wherein the distance between adjacent outer explosive charges is about equal to the distance between adjacent central explosive charges.

7. The method according to claim 6 wherein the distance between such an outer explosive charge and an adjacent central explosive charge is about equal to the distance between adjacent central explosive charges.

8. A method for explosively expanding formation toward a void in a subterranean formation, comprising the steps of:

excavating at least one void in the subterranean formation, such a void bounded by generally horizontally extending zones of unfragmented formation above and below the void, the surface of each such zone of unfragmented formation bounding the void forming a free face towards which such formation is to be expanded;

placing an array of horizontally spaced apart explosive charges in at least one of the zones of unfragmented formation, the array of explosive charges comprising a plurality of central explosive charges spaced apart from the plane of the side walls of the void and a plurality of outer explosive charges surrounding the central charges, the powder factor of such an outer explosive charge being in the range of from about one-half to about one and one-half times the powder factor of such a central explosive charge; and detonating the explosive charges for explosively expanding such a zone of unfragmented formation toward the horizontally extending void.

9. The method according to claim 8 wherein the powder factor of each such outer explosive charge is about equal to the powder factor of each such central explosive charge.

10. The method according to claim 8 wherein the distance from the plane of such a side wall of the void to an outer explosive charge is no greater than about one-half the distance between adjacent outer explosive charges.

11. The method according to claim 8 wherein the outer explosive charges are adjacent the plane of the side walls of the void.

12. The method according to claim 11 wherein the distance from such an outer explosive charge to an adjacent central explosive charge is about equal to the distance between adjacent central explosive charges.

13. The method according to claim 8 wherein the distance between adjacent outer explosive charges is about equal to the distance between adjacent central explosive charges.

14. A method for forming a fragmented permeable mass of formation particles in an in situ oil shale retort in a retort site in a subterranean formation containing oil shale, the in situ oil shale retort site having top, bottom, and side boundaries of unfragmented formation comprising the steps of:

excavating at least one horizontally extending void in the subterranean formation within the boundaries of the retort site, leaving zones of unfragmented formation above and below such a void;

placing an array of horizontally spaced apart substantially vertical columnar explosive charges in at least one of the zones of unfragmented formation, the array of explosive charges comprising a plurality of central explosive charges spaced apart from the side boundaries of the retort site and a plurality of outer explosive charges adjacent the side boundaries of the retort site surrounding the central charges, such an outer explosive charge having a powder factor about equal to the powder factor of such a central explosive charge; and detonating the explosive charges for explosively expanding the zone of unfragmented formation toward the void for forming a fragmented permeable mass of formation particles in the in situ oil shale retort.

15. The method according to claim 14 wherein the distance between such an outer explosive charge and an adjacent central explosive charge is about equal to the distance between adjacent central explosive charges.

16. The method according to claim 14 wherein the actual depth of burial of such an outer explosive charge is about equal to the actual depth of burial of such a central explosive charge.

17. The method according to claim 14 wherein the distance between adjacent outer explosive charges is about equal to the distance between adjacent central explosive charges.

18. The method according to claim 14 wherein the distance between adjacent outer explosive charges is less than the distance between the central explosive charges.

19. The method according to claim 14 wherein the column length of such an outer explosive charge is about equal to the column length of such a central explosive charge.

20. A method for forming a fragmented permeable mass of formation particles in an in situ oil shale retort in a retort site in a subterranean formation containing oil shale, the in situ oil shale retort site having top, bottom, and side boundaries of unfragmented formation, comprising the steps of:

excavating at least one generally horizontally extending void in the subterranean formation, leaving zones of unfragmented formation above and below such a void;

forming an array of horizontally spaced apart blastholes in at least one of the zones of unfragmented formation, the array of blastholes comprising a plurality of central blastholes spaced apart from the side boundaries of the retort site and a plurality of outer blastholes adjacent such a side boundary of the retort site;

loading the central blastholes with explosive charges to thereby form a plurality of central explosive charges in such central blastholes, each such explosive charge extending across the entire horizontal cross-section of its blasthole;

loading the outer blastholes with explosive charges to thereby form a plurality of outer explosive charges in such outer blastholes, each such explosive charge extending across the entire horizontal cross-section of its blasthole, each outer explosive charge having a powder factor about equal to the powder factor of each central explosive charge; and detonating the outer and central explosive charges for explosively expanding the zone of unfragmented formation toward the void for forming a fragmented permeable mass of formation particles in the in situ oil shale retort.

21. The method according to claim 20 wherein such an outer explosive charge has an actual depth of burial about equal to the actual depth of burial of such a central explosive charge.

22. The method according to claim 20 wherein the column length of such an outer explosive charge is about equal to the column length of such a central explosive charge.

23. The method according to claim 20 wherein the spacing distance between outer explosive charges is about equal to the spacing distance between central explosive charges.

24. The method according to claim 20 wherein the distance between such an outer explosive charge and an adjacent central explosive charge is about equal to the distance between adjacent central explosive charges.

25. The method according to claim 20 wherein the column length of the outer and central explosive charges is about equal to one-half the thickness of the zone of unfragmented formation being expanded.

26. A method for forming a fragmented permeable mass of formation particles in an in situ oil shale retort in a retort site in a subterranean formation containing oil shale, the in situ oil shale retort site having top, bottom, and side boundaries of unfragmented formation, comprising the steps of:

excavating at least one generally horizontally extending void in the subterranean formation within the boundaries of the retort site, leaving zones of unfragmented formation above and below such a void;

forming an array of horizontally spaced apart substantially vertical blastholes in at least one of the zones of unfragmented formation, the array of blastholes comprising a plurality of central blastholes spaced apart from the side boundaries of the retort site and a plurality of outer blastholes adjacent such a side boundary of the retort site;

loading the central blastholes with explosive for forming a vertical columnar central explosive charge in each such central blasthole;

loading the outer blastholes with explosive for forming a vertical columnar outer explosive charge in each such outer blasthole, each outer explosive charge having a powder factor in the range of from about one-half to less than twice the powder factor of each central explosive charge; and detonating the explosive charges for explosively expanding the zone of unfragmented formation toward the void for forming a fragmented permeable mass of formation particles in the in situ oil shale retort.

27. The method according to claim 26 wherein each such outer explosive charge extends across the entire horizontal cross-section of its blasthole and each such central explosive charge extends across the entire horizontal cross-section of its blasthole.

28. The method according to claim 26 wherein the distance between such an outer blasthole and an adjacent central blasthole is about equal to the distance between adjacent central blastholes.

29. The method according to claim 27 wherein the distance between adjacent outer blastholes is about equal to the distance between adjacent central blastholes.

30. The method according to claim 27 wherein the powder feactor of each outer explosive charge is about equal to the powder factor of each central explosive charge.

31. A method for forming a fragmented permeable mass of formation particles in an in situ oil shale retort in a retort site in a subterranean formation containing oil shale, the in situ oil shale retort site having top, bottom, and side boundaries of unfragmented formation, comprising the steps of:

excavating at least one generally horizontally extending void in the subterranean formation within the boundaries of the retort site, leaving zones of unfragmented formation above and below such a void;

forming at least one row of horizontally spaced apart central explosive charges remote from the side boundaries of the retort site in at least one of the zones of unfragmented formation;

forming a band of horizontally spaced apart outer explosive charges surrounding the central explosive charges in such a zone of unfragmented formation, the band of outer explosive charges comprising a row of outer explosive charges adjacent such a side boundary of the retort site, the powder factor of such a row of outer explosive charges being about equal to the powder factor of such a row of central explosive charges; and detonating the explosive charges for explosively expanding the zone of unfragmented formation toward the horizontally extending void for forming a fragmented permeable mass of formation particles in the in situ oil shale retort.

32. The method according to claim 31 wherein each such central explosive charge has about the same actual depth of burial as each such outer explosive charge.

33. The method according to claim 31 wherein the central and outer explosive charges are substantially vertical columnar explosive charges and each such central explosive charge has a charge length equal to the charge length of each such outer explosive charge.

34. The method according to claim 31 wherein the distance between such an outer explosive charge and an adjacent central explosive charge is about equal to the distance between adjacent central explosive charges.

35. The method according to claim 34 wherein the distance between adjacent outer explosive charges is about equal to the distance between adjacent central explosive charges.

36. A method for forming a fragmented permeable mass of formation particles in an in situ oil shale retort in a retort site in a subterranean formation containing oil shale, the in situ oil shale retort site having top, bottom, and side boundaries of unfragmented formation, comprising the steps of:

excavating at least one generally horizontally extending void in the subterranean formation within the boundaries of the retort site, leaving zones of unfragmented formation above and below such a void;

forming a central array of blastholes comprising rows of spaced apart substantially vertical central blastholes in at least one of the zones of unfragmented formation;

forming a band of substantially vertical outer blastholes surrounding the central blastholes in such a zone of unfragmented formation, the band of outer blastholes comprising a row of outer blastholes along such a side boundary of the retort site;

loading the central blastholes with explosive for forming a vertical columnar central explosive charge in such a central blasthole extending across the entire horizontal cross-section of the central blasthole;

loading the outer blastholes with explosive for forming a vertical columnar outer explosive charge in such an outer blasthole extending across the entire horizontal cross-section of the outer blasthole, the powder factor of each row of outer explosive charges being about equal to the powder factor of each row of central explosive charges; and detonating the explosive charges for explosively expanding the zone of unfragmented formation toward the horizontally extending void for forming a fragmented permeable mass of formation particles in the in situ oil shale retort.

37. The method according to claim 36 wherein the spacing distance between an outer blasthole and an adjacent central blasthole is about equal to the spacing distance between the central blastholes.

38. The method according to claim 36 wherein the spacing distance between the central blastholes is about equal to the spacing distance between the outer blastholes.

39. The method according to claim 36 wherein the actual depth of burial of each outer explosive charge is about equal to the actual depth of burial of each central explosive charge.

40. The method according to claim 36 wherein the column length of each outer and central explosive charge is about equal to one-half the thickness of the zone of unfragmented formation being expanded.

41. The method according to claim 36 wherein the column length of each outer explosive charge is about equal to the column length of each central explosive charge.

* * * * *

UNITED STATES PATENT AND TRADEMARK OFFICE

CERTIFICATE OF CORRECTION

PATENT NO. : 4,366,987

DATED : 01-07-83

INVENTOR(S) : Thomas E. Ricketts; Robert J. Fernandes

It is certified that error appears in the above—identified patent and that said Letters Patent is hereby corrected as shown below:

Please add the following language as the first paragraph under the heading "Background of the Invention".

--The Government has rights in this invention pursuant to Contract No. DE-FC20-78-LC10036 (formerly EF-77-A-04-3873) awarded by the U.S. Department of Energy.--

Signed and Sealed this

*Second* Day of *August 1983*

[SEAL]

*Attest:*

GERALD J. MOSSINGHOFF

*Attesting Officer*

*Commissioner of Patents and Trademarks*